US009988928B2

(12) United States Patent
Popescu et al.

(10) Patent No.: US 9,988,928 B2
(45) Date of Patent: Jun. 5, 2018

(54) SYSTEMS AND METHODS FOR DETERMINING TURBOMACHINE ENGINE SAFE START CLEARANCES FOLLOWING A SHUTDOWN OF THE TURBOMACHINE ENGINE

(71) Applicant: Siemens Energy, Inc., Orlando, FL (US)

(72) Inventors: Cristina C. Popescu, Marvin, NC (US); Michael J. Olejarski, Merritt Island, FL (US); Timothy E. Mazzotta, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 122 days.

(21) Appl. No.: 15/156,640

(22) Filed: May 17, 2016

(65) Prior Publication Data

US 2017/0335714 A1 Nov. 23, 2017

(51) Int. Cl.
*F01D 19/02* (2006.01)
*F01D 25/12* (2006.01)
(Continued)

(52) U.S. Cl.
CPC ..... *F01D 19/02* (2013.01); *F01D 9/02* (2013.01); *F01D 21/003* (2013.01); *F01D 25/12* (2013.01);
(Continued)

(58) Field of Classification Search
CPC ..... F01D 19/02; F01D 9/02; F01D 21/003; F01D 25/12; F01D 25/24; F01D 2220/32; F01D 2240/307
See application file for complete search history.

(56) References Cited

U.S. PATENT DOCUMENTS 4,856,272 A * 8/1989 Putman ..... F01D 11/24 415/116
5,005,352 A * 4/1991 Schwarz ..... F01D 11/24 60/782
(Continued)

FOREIGN PATENT DOCUMENTS

EP 1892510 A1 * 2/2008 ..... A47J 27/62
EP 2548990 A1 * 1/2013 ..... C23C 14/021
(Continued)

OTHER PUBLICATIONS

PCT International Search Report and Written Opinion of International Searching Authority dated Nov. 9, 2017 corresponding to PCT International Application No. PCT/US2017/029045 filed Apr. 24, 2017.

*Primary Examiner* — Tuan C To

(57) ABSTRACT

System and methods for predicting a turbomachine engine safe start clearance following a shutdown of the turbomachine engine is provided. The system includes a controller operatively connected to a plurality of temperature detecting means (TDM). The TDMs are arranged at an upper and lower part of the engine casing, and are configured to sense parameters of the engine and to transmit the sensed parameters to the controller. The controller is configured to receive the sensed parameters and to determine, via a control application of the controller, whether components of the engine have sufficient clearance. The controller is further configured to transmit the clearance information, e.g., to a user. Based on the clearance information, the turbomachine engine is restarted.

20 Claims, 5 Drawing Sheets

(51) Int. Cl.
*F01D 9/02* (2006.01)
*F01D 25/24* (2006.01)
*F01D 21/00* (2006.01)

(52) U.S. Cl.
CPC ..... *F01D 25/24* (2013.01); *F05D 2220/32* (2013.01); *F05D 2240/307* (2013.01)

(56) References Cited

U.S. PATENT DOCUMENTS 5,127,793 A * 7/1992 Walker ..... F01D 11/08 415/115
5,211,534 A * 5/1993 Catlow ..... F01D 11/22 415/170.1
5,388,960 A * 2/1995 Suzuki ..... F01D 25/12 415/108
6,401,460 B1 * 6/2002 Xia ..... F01D 11/24 415/14
7,798,767 B2 9/2010 Kondo et al.
8,820,091 B2 9/2014 Tham et al.
8,893,510 B2 11/2014 Tham et al.
9,212,625 B2 * 12/2015 Shelley ..... F02K 5/00
9,784,215 B2 * 10/2017 Lu ..... F02K 1/80
9,818,242 B2 * 11/2017 Volponi ..... G07C 5/0808
2004/0079070 A1 * 4/2004 Macchia ..... F01D 17/085 60/39.091
2008/0092516 A1 * 4/2008 Lockwood ..... F02C 7/047 60/39.093
2008/0310949 A1 12/2008 Kondo et al.
2012/0266601 A1 * 10/2012 Miller ..... F01D 25/14 60/772
2012/0297781 A1 * 11/2012 Manchikanti ..... F01D 11/24 60/772
2013/0084162 A1 * 4/2013 Sano ..... F01D 11/24 415/116
2014/0156165 A1 * 6/2014 Ewens ..... F02C 9/28 701/100
2014/0331637 A1 * 11/2014 Laurello ..... F02C 7/24 60/39.5
2015/0159572 A1 * 6/2015 Knudsen ..... F02D 41/1446 60/605.1
2015/0267621 A1 * 9/2015 Garcia-Crespo ..... F02C 9/40 60/772
2015/0354465 A1 * 12/2015 Suciu ..... F02C 3/04 60/782
2015/0354822 A1 * 12/2015 Suciu ..... F23R 3/10 60/772
2016/0177772 A1 * 6/2016 Smith ..... G01J 5/0088 415/1
2017/0236064 A1 * 8/2017 Kirschnick ..... G06N 5/04 702/35
2018/0030903 A1 * 2/2018 Asti ..... F02C 9/22

FOREIGN PATENT DOCUMENTS

EP 3012415 A1 4/2016
GB 2389174 A * 12/2003 ..... F28D 15/02
JP 2007272529 A * 10/2007 ..... H05K 7/20563

* cited by examiner

SYSTEMS AND METHODS FOR DETERMINING TURBOMACHINE ENGINE SAFE START CLEARANCES FOLLOWING A SHUTDOWN OF THE TURBOMACHINE ENGINE

TECHNICAL FIELD

This present disclosure relates generally to turbomachines, and more particularly, to systems and methods for predicting a turbomachine engine safe start clearance after a shutdown of the turbomachine engine.

BACKGROUND

Following a shutdown of a turbomachine, e.g., a Gas Turbine (GT) engine, a bowing of one or more components, e.g., the turbine casing, may result, which increases the risk of other components, e.g., the turbine blade tips, rubbing upon restarting the GT. To reduce the rubbing risks, e.g., Direct Air Injection Systems (DAIS) have focused on controlling the top half casing temperature for the mid-frame shell (and all TVC cavities) with good results, provided the DAIS system is operational across the shutdown. An example of this type of DAIS system is described in U.S. Pat. Nos. 8,893,510 and 8,820,091, both disclosures of which are incorporated herein by reference in its entirety for describing the DAIS systems.

However, engine operational disturbances during shutdown do occur, e.g., equipment failures and operational limits resulting in engine trips, which impacts the DAIS operation, and therefore, may increase rubbing risks. Due in part to these disturbances, the DAIS system enforces a time based engine start lockout period, e.g., of approximately 30-50 hours, which limits the ability to restart the GT prior to it achieving a fully cooled condition. This restriction period generally continues until natural convention effects start to diminish and a clearance of any rubbing risks is achieved, resulting in the GT being safe to restart. Consequently, during this restart restriction period, the GT is unavailable for an extended period of time, as the full duration of the restriction period must be achieved, regardless of whether any rubbing risks exist at any point during the lockout restriction period.

Therefore, a need exists for an improved system and method for determining rubbing risks within the GT for safely starting the GT, and independent of the DAIS and any disturbances.

SUMMARY

In one exemplary embodiment, a method for predicting/determining rubbing risks of one or more components within a turbomachine engine for safely starting the turbomachine engine following a shutdown of the turbomachine engine is provided. The method includes: monitoring one or more parameters of the turbomachine engine, via a plurality of temperature detecting means selectively arranged about an upper and corresponding lower part of the turbomachine, during a cool down cycle of the GT operating on Turning Gear.

The method further includes: determining whether the monitored parameters identifies that one or more components of the turbomachine, e.g., turbine blade tips, are above a minimum clearance value, and restarting the turbomachine based upon the monitored parameters and upon identifying that the components are above the minimum clearance required.

In yet a further exemplary embodiment, a system for restarting a turbomachine engine is provided. The system includes: a controller operatively connected to a plurality of temperature detecting means. The plurality of temperature detecting means may be selectively arranged at an upper and corresponding lower part of a casing of the turbomachine for detecting one or more parameters of the turbomachine engine. At least one of the temperature detecting means may be operably configured to transmit the detected parameters to the controller for processing by a control application of the controller. The controller is operably configured to receive the parameters from the temperature detecting means, and to determine, via the control application, whether any components of the turbomachine, e.g., turbine tips, are above a minimum clearance value. Upon determining that the components are above the minimum required clearance, the controller may be configured to transmit or display the clearance information, e.g., to a user, for restarting the turbomachine based at least in part of the detected parameters.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

The components and materials described hereinafter as making up the various embodiments are intended to be illustrative and not restrictive. Many suitable components and materials that would perform the same or a similar function as the materials described herein are intended to be embraced within the scope of embodiments of the present invention.

In general, the computing systems and devices described herein may be assembled by a number of computing components and circuitry such as, for example, one or more processors (e.g., Intel®, AMD®, Samsung®) in communication with memory or other storage medium. The memory may be Random Access Memory (RAM), flashable or non-flashable Read Only Memory (ROM), hard disk drives, flash drives, or any other types of memory known to persons of ordinary skill in the art and having storing capabilities. The computing systems and devices may also utilize cloud computing technologies, via the internet, to facilitate several functions, e.g., storage capabilities, executing program instructions, etc., as described in further detail below. The computing systems and devices may further include one or more communication components such as, for example, one or more network interface cards (NIC) or circuitry having analogous functionality, one or more one way or multi-directional ports (e.g., bi-directional auxiliary port, universal serial bus (USB) port, etc.), in addition to other hardware and software necessary to implement wired communication with other devices. The communication components may further include wireless transmitters, a receiver (or an integrated transceiver) that may be coupled or connected to broadcasting hardware of the sorts to implement wireless communication within the system, for example, an infrared transceiver, Bluetooth transceiver, or any other wireless communication know to persons of ordinary skill in the art and useful for facilitating the transfer of information. Additionally, a power supply/pack (e.g., hard wired, battery, etc.) may be included in any of the computing devices described herein. These power supplies may also include some form of redundancy or a backup power means known to persons of ordinary skill and for maintaining the functionality of the computing devices and/or components described herein.

Figure 1:
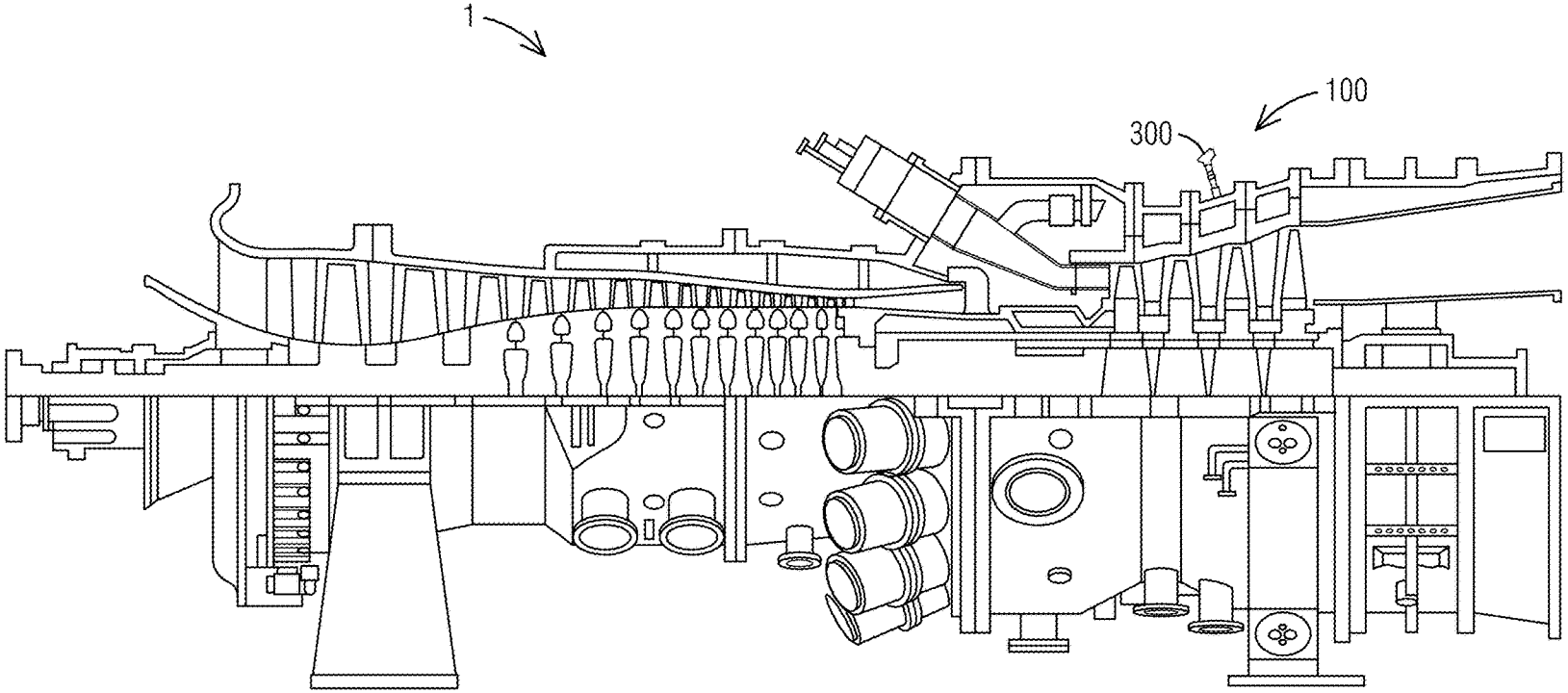
FIG. 1 illustrates a cutaway perspective view of a turbomachine including a system for determining rubbing risks of one or more components of the turbomachine following a shutdown, and in accordance with the disclosure provided herein.

Referring now to the drawings wherein the showings are for purposes of illustrating embodiments of the subject matter herein only and not for limiting the same, FIG. 1 illustrates a turbomachine 1, e.g., a gas turbine engine (GT), having a system 100 for determining the rubbing risks of one or more components of the GT 1 following a shutdown of the GT 1.

The system 100 provides a risk assessment means for predicting the clearance of one or more components of the GT 1, e.g., turbine blade tips, in both a normal and disturbed DAIS operation, to enable restarting the GT 1 at any time during the turning gear operation, e.g., and as soon as it is determined that the components are above a minimum clearance value, i.e., are cleared, versus waiting for a complete cool down of the engine as determined by an engine start lockout period and/or temperature based lockout period.

Figure 2:
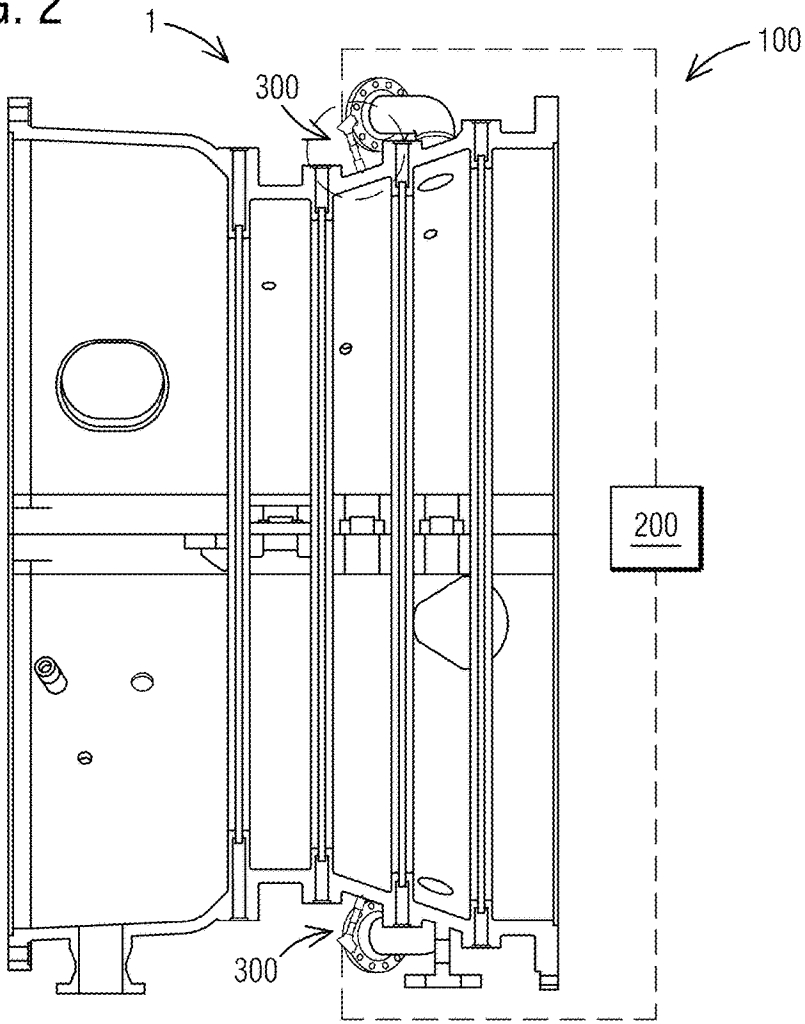
FIG. 2 is a sectional perspective view of the turbomachine and system of FIG. 1 with a temperature detection means arranged about an upper and lower part of a casing of the turbomachine, and in accordance with the disclosure provided herein.

With reference to FIG. 2, the system 100 may include a controller 200 operative connected to one or more temperature detecting means (TDM) 300, via a wired and/or wireless connection 102. The controller 200 may include a processing circuit operatively connected to a memory and/or storage medium having a control application stored thereon. The control application may include various instructions, which upon execution by the processing circuit, may cause the controller to process parameters transmitted from the TDM 300 for determining whether any rubbing risks exists within the GT 1, e.g., turbine blade tips, and for determining when it is safe to restart the GT 1.

Figure 3:
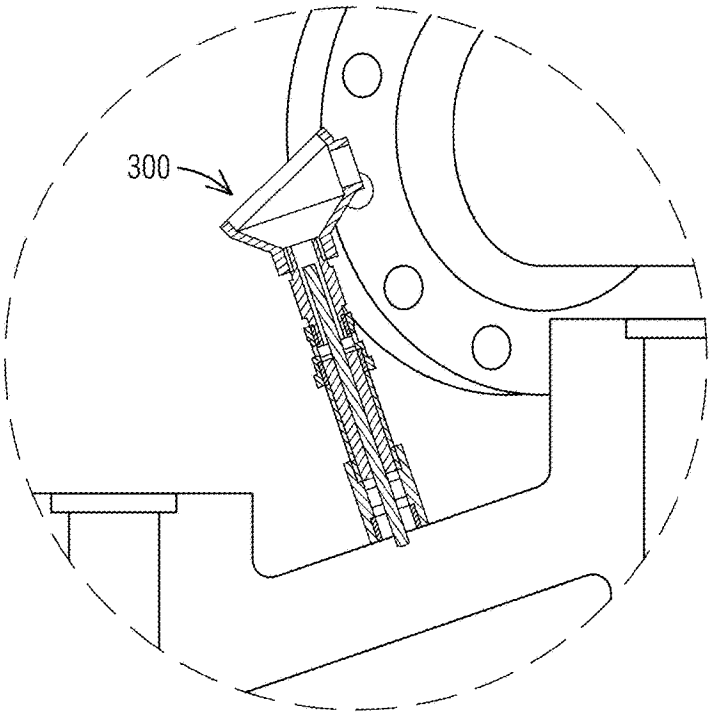
FIG. 3 is an enlarged illustration of the temperature detecting means of FIG. 2 arranged at the upper part of the turbomachine casing, and in accordance with the disclosure provided herein.

As shown in FIG. 3, the TDM 300 may be a duplex thermocouple, or similar device, operably configured to measure and/or detect one or more parameters of the GT 1, e.g., casing temperatures, and to transmit the detected parameters to, e.g., the controller 200, another TDM 300, or other device of the system 100, for predicting any rubbing risks and a safe start clearance. In one embodiment, the TDM 300 may include one or more channels which may be redundant to each other to assure that any measured parameters are successfully transmitted to the controller 200.

In the embodiment of FIG. 2, a first TDM 300 may be selectively arranged at a top dead center (TDC) of a casing 10 of the GT 1. A second TDM 300 may be selectively arranged at a corresponding bottom dead center (BDC) of the casing 10. The TDMs 300 may be secured to the casing 10 via one or more fasteners (not shown), or by other means known to persons of ordinary skill in the art and capable of securing a measuring/sensing device to the casing 10. In this embodiment, selectively securing or arranging the TDMs 300 at both the TDC and BDC of the casing 10 allows for corresponding parameters of the GT 1, e.g., the casing temperatures at the TDC and BDC, to be measured, transmitted, and/or streamed to the controller 200 for real time analysis of both casing temperatures (upper and lower) for determining the rubbing risks of the internal components of the GT 1.

Figure 4:
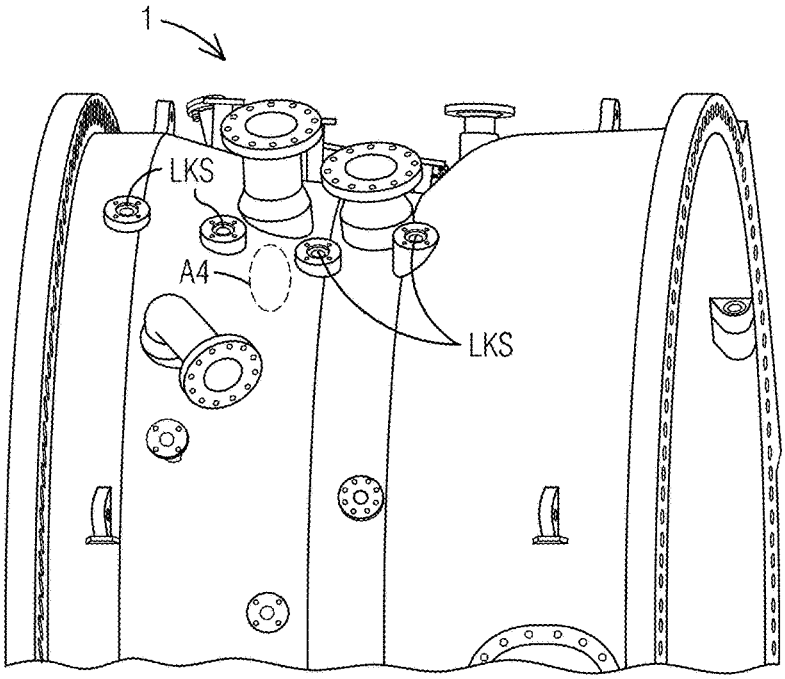
FIG. 4 is a further perspective view of the temperature detecting means arranged at the upper part of the turbomachine casing, and in accordance with the disclosure provided herein.
Figure 5:
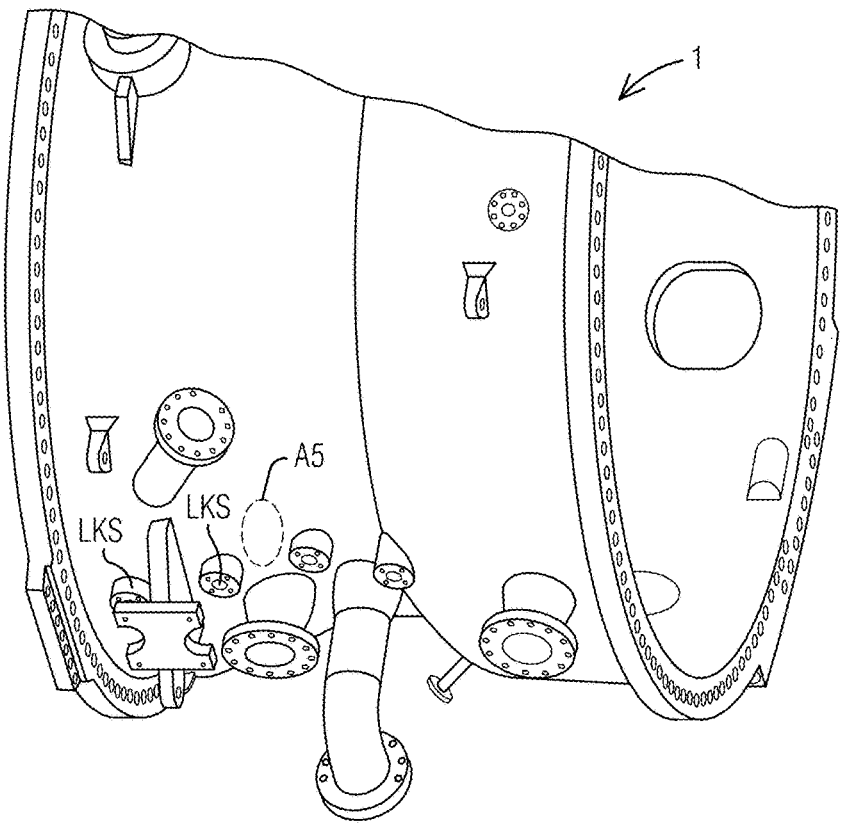
FIG. 5 is a further perspective view of the temperature detecting means arranged at the lower part of the turbomachine casing, in accordance with the disclosure provided herein.

As illustrated in the embodiments of FIGS. 4 and 5, the first TDM 300 may be arranged and/or centered at area A4 between the row 2 and 3 locking key stubs LKS at the TDC, with the second corresponding TDM 300 centered at area A5 between the row 2 and 3 locking key stubs LKS at the BDC (FIG. 5). It should be appreciated that the row 1 blade tips may pose a higher rubbing risk than any other row blade tips, and because the areas at A4 and A5 may generally be the hottest part of the casing 10, arranging the TDM 300 at or proximate to the hottest part of the casing 10, e.g., areas A4, A5, may provide the optimal parameters for determining the row 1 blade tip clearances for a safe start of the GT 1, as the casing 10 temperatures measured between the row 2 and 3 locking key stubs LKS may correlate to the clearance of the row 1 blade tips.

With continued reference to the figures, upon measuring the casing temperatures at the TDC of area A4 and the BDC of area A5, the TDM 300 may be configured to transmit the measured temperatures, via one or more control signals, to the controller 200 for monitoring of the casing 10 temperatures at A4 and A5, e.g., in real-time, to determine, via the control application, whether the measured temperatures are indicative of the turbine blade tips being above a minimum clearance value required for a safe restart of the GT 1, e.g., while on Turning Gear Operation.

In one exemplary embodiment, to determine a safe to start condition for the GT 1, the controller 200, under the control of the control application, applies the temperatures values from the TDC and BDC in the following formula:

$$STCLR1_{Bot}=A+B\cdot\mathrm{Top}+C\cdot\mathrm{Top}^2+D\cdot\mathrm{Bot}+E\cdot\mathrm{Bot}^2+F\cdot\mathrm{Top}\cdot\mathrm{Bot}-\mathrm{Min}$$

$$STCLR1_{Top}=A+B\cdot\mathrm{Top}+C\cdot\mathrm{Top}^2+D\cdot\mathrm{Bot}+E\cdot\mathrm{Bot}^2+F\cdot\mathrm{Top}\cdot\mathrm{Bot}-\mathrm{Min}$$

Figure 7:
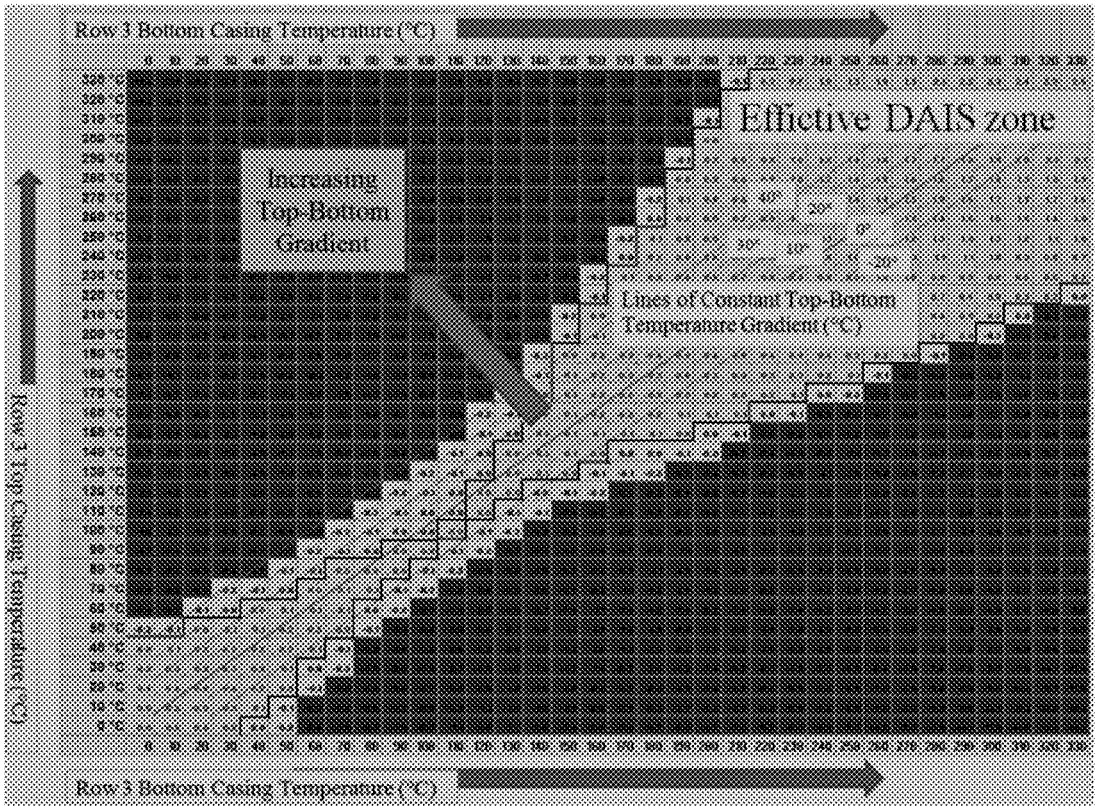
FIG. 7 is a graph indentifying parameters for determining a safe to start zone for one or more turbomachine engines in the SGT6-5000F frame family, and in accordance with the disclosure provided herein.

In this embodiment, the two formulas assist in predicting the row one turbine blade clearances at the engine top and bottom, which may also be referred to as the Effective DAIS Zone. The formulas may be second order polynomial functions in two variables, with the two variables, Top and Bot, being representative of the casing 10 temperatures from the TDM 300 at the TDC and BDC, respectively. It should be appreciated that the above constants (A, B, C, D, E, F, and Min) depend on the GT 1 type, the blade clearance location (top and/or bottom), and the cold build clearance. Upon applying the TDM 300 provided values (casing temperatures) and the constants to the above formulas, a determination that the GT 1 is safe to start is achieved once the resultants of the formulas return positive values, which may be represented by: CalcStoSR1_Min=Min ($STCLR1_{Bot}$, $STCLR1_{Top}$)>0 ⇒ Safe to start (Effective DAIS Zone). FIG. 7 illustrates an exemplary graph of an Effective DAIS Zone for Siemens Gas Turbines in the frame family operating with DAIS and 3 rpm or 120 rpm turning gear.

It should further be appreciated that the values of the constants A through F may be determined through best-fit methods for a particular frame, casing half, operating and shutdown process for a particular GT 1. As previously indicated, these constants may be representative of the values that minimize the error in estimating, under appropriate restrictions and weighting, the actual clearance by a quadratic (or 2nd order polynomial) function in two variables, Top and Bot (temperatures). The values of these constants may not directly correspond to any physical quantity, but rather, provides, e.g., via the above formulas, best estimates of clearances. The Min constant may be representative of an acceptable lower limit on the clearance estimation which allows for a restart of the GT 1.

Figure 6:
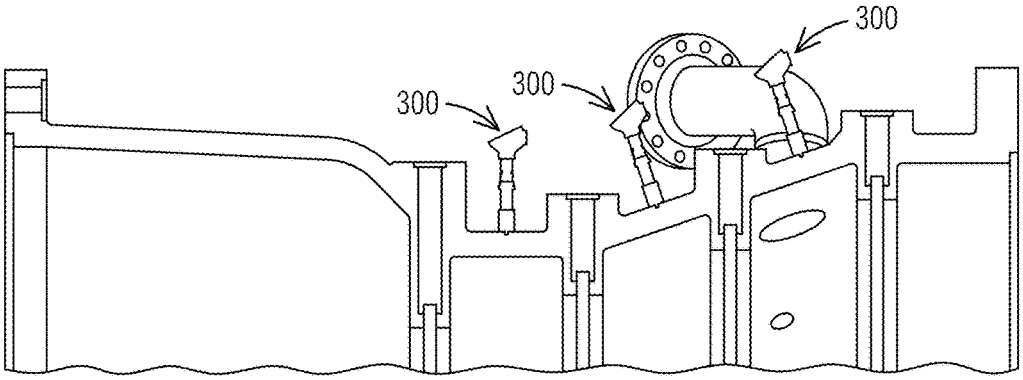
FIG. 6 is a perspective view of a further exemplary embodiment of the turbomachine and system of FIG. 2 with a plurality of temperature detecting means arranged about the upper part of the turbomachine casing, and in accordance with the disclosure provided herein.

With reference now to FIG. 6, in yet a further exemplary embodiment, a plurality of TDMs 300 may be arranged at the upper part of the casing 10, with a plurality of TDMs 300 arranged at a corresponding lower part of the casing 10.

In this embodiment, a first TDM 300 of the plurality of TDMs 300 arranged at the upper part of the casing 10 may function as a primary upper TDM 300, with the remaining TDM's 300 at the upper part of the casing functioning as backup or redundant TDMs 300. Similarly, a first TDM 300 of the plurality of TDMs 300 may be arranged at the lower part of the casing 10 and may function as a primary lower TDM 300, with the remaining TDM's 300 at the lower part of the casing functioning as backup or redundant TDMs 300. The upper and/or lower backup TDMs 300 may be configured to provide additional information to supplement any detected information provided by the primary TDMs 300, e.g., further component temperatures, and/or to provide redundancy, e.g., should any of the TDMs 300 go offline. It should be appreciated that the additional TDMs 300 may be similarly configured to the primary TDMs 300 for detecting and transmitting the GT 1 casing temperatures to the controller 200, or in a further embodiment, configured to transmit the detected parameters to another device or TDM 300 in operable communication with the controller 200, should the primary TDM 300 go offline or be unable to transmit any information needed to predict a safe start clearance.

In yet a further embodiment, the control application may include instructions for identifying that the GT 1 is safe to start, and additionally or alternatively instructions for restarting the GT 1. For example, upon determining that no rubbing risks exists, i.e., the blade tips are above the minimum clearance required, the control application may generate a message (visual or audible) indicative of the achieved clearance, which may be played or displayed, e.g., on a display (not shown) operatively connected to the controller, for notifying an operator of the system that the GT 1 may be safely restarted. The operator may then manually restart the GT 1 engine, or in a further embodiment, the control of the control application may include instructions which may cause the controller to automatically begin restarting the GT 1, e.g., without further operator intervention. It should be appreciated that, as disclosed herein, restarting the GT 1 may be generally independent of any recommended restart periods based on time and/or temperature.

Alternatively or additionally, the system 100 may include one or more cooling valves operatively connected to the controller 200 or other device of the system for further minimizing any rubbing risks of the interior components by cooling the components during the turning gear operation, which, e.g., may assist in reducing bowing within the GT 1. In this embodiment, operation of the cooling valves may be dependent on the parameters transmitted to the controller 200 from the TDM 300. For example, upon receiving the measured temperatures and identifying that a rubbing risk exists, the controller 200, under the control of the control application, may cause one or more of cooling values operably connected thereto to activate, resulting in the cooling valves dispersing a cooling medium or air for cooling the internal components to reduce the rubbing risks and also the period of time between shutdown and restarting the GT 1.

Figure 8:
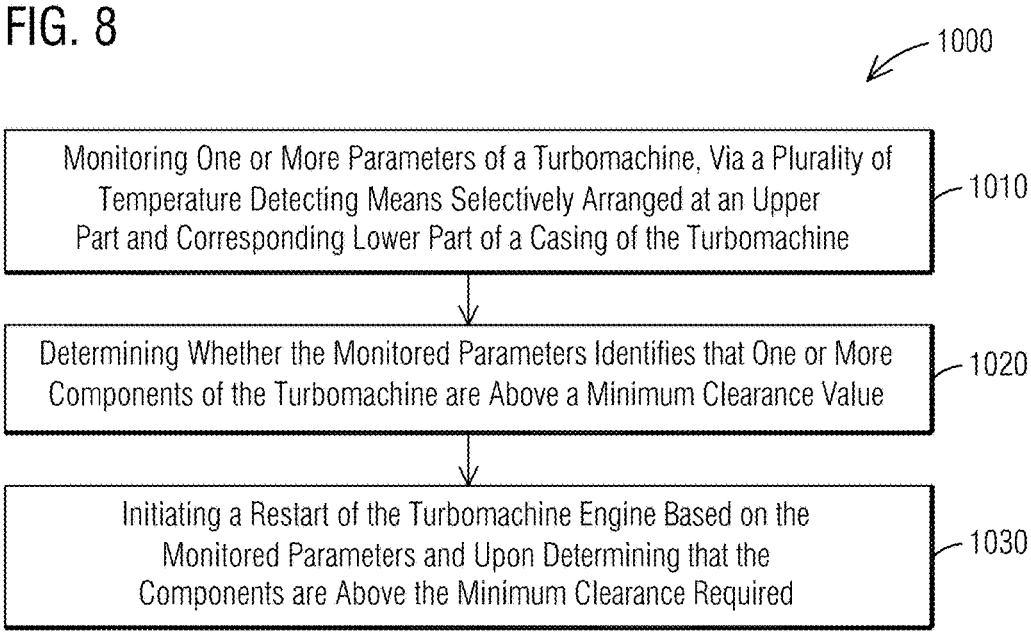
FIG. 8 is a flowchart for an embodiment of a method for predicting rubbing risks of components within a turbomachine engine in order to safely start the turbomachine engine following a shutdown of the turbomachine engine, and in accordance with the disclosure provided herein.

With reference now to FIG. 8, a flowchart for an embodiment of a method 100 for predicting rubbing risks and determining whether the GT 1 is safe to start following a shutdown of the turbomachine engine is provided.

In step 1010, the method 1000 includes the step of monitoring one or more parameters of the GT 1, e.g., casing 10 temperatures, via one or more TDM 300. It should be appreciated that the monitoring of the casing temperatures may begin at anytime once the TDM 300 is attached to the GT 1. For example, the TDM 300 may begin to detect and transmit the monitored temperatures upon initiating a shutdown of the GT 1, or shortly thereafter, or immediately upon a disturbance occurring during the DAIS operation. In step 1020, the method 100 includes the step of determining whether the detected/monitored temperatures identifies that one or more components, e.g., row 1 blade tips, are above a minimum clearance value. In this step, the TDM 300 may transmit and/or stream the detected parameters to the controller 200 so that the controller 200, under the control of the control application, may begin to process the parameters to determine the clearance of the blade tips. Upon determining that the components are above the minimum clearance required, in step 1030, the method 1000 includes the step of restarting the GT 1. The GT 1 may be restarted manually by an operator upon receiving an indication that the minimum clearance is achieved, or automatically, via the controller 200, upon determining that no rubbing risk exists.

It should be appreciated that any restriction period (time or temperature) may be delayed while implanting the method 1000 or while utilizing the system 100. That is, any period that may be typically imposed, may remain passive until a safe to start condition is determine. In delaying the start of restriction period, operators are now able to restart the GT 1 upon achieving actual clearance versus being forced to wait for a predetermined amount of time.

It should be further appreciated, that the controller 200, under the control of the control application, may initiate or enforce a temperature based restriction period upon delaying the time based restriction. That is, the control application may include instructions to restrict starting the GT 1 based on the monitored temperatures. In this embodiment, the temperature based restriction may remain in place until it is determined that the components of the GT 1 have achieved the minimum clearance required.

For example, additionally or alternatively, upon the restart restriction period being started, the controller 200, under the control of the control application, may continue to monitor the parameters at TDC and BDC to determine the condition of, e.g., the row 1 blade tips, i.e., to determine whether or not the blade tips have achieved the minimum clearance required for restarting the GT 1. Upon determining that the blade tips have achieved the minimum clearance required, the imposed restart restriction period may be terminated, e.g., via the controller 200, and the operator may be notified that the GT 1 is ready to be restarted. Additionally or alternatively, upon determining that the minimum clearance is achieved, the controller 200, via the control application, may automatically begin to restart the GT 1.

While specific embodiments have been described in detail, those with ordinary skill in the art will appreciate that various modifications and alternative to those details could be developed in light of the overall teachings of the disclosure. For example, elements described in association with different embodiments may be combined. Accordingly, the particular arrangements disclosed are meant to be illustrative only and should not be construed as limiting the scope of the claims or disclosure, which are to be given the full breadth of the appended claims, and any and all equivalents thereof. It should be noted that the terms "comprising", "including", and "having", are open-ended and does not exclude other elements or steps and the use of articles "a" or "an" does not exclude a plurality. Additionally, the steps of various methods disclosed herein are not required to be performed in the particular order recited, unless otherwise expressly stated.

We claim:

1. A method in a controller operably connected to a plurality of sensors selectively arranged on a turbomachine engine for determining a safe start clearance for the turbomachine engine following a shutdown, comprising:

monitoring parameters of the turbomachine engine, via the plurality of sensors;

identifying an upper casing temperature and a lower casing temperature from the monitored parameters;

determining whether a component of the turbomachine engine is above a minimum clearance value for the turbomachine engine based in part on the identified casing temperatures; and initiating a restart of the turbomachine engine upon determining that the component is above the minimum clearance value.

2. The method of claim 1, wherein initiating a restart of the turbomachine engine comprises:

generating a message indicative of the component being above the minimum clearance and transmitting the message to an operator.

3. The method of claim 1, wherein initiating a restart of the turbomachine engine comprises:

generating a restart signal and transmitting the signal to the turbomachine engine to restart the turbomachine engine while operating on turning gear.

4. The method of claim 1, wherein the plurality of sensors includes a first sensor arranged at an upper part of a casing of the turbomachine, and a second sensor arranged at a corresponding lower part of the casing.

5. The method of claim 4, wherein the first and second sensors are arranged relative to the turbomachine row two and three locking key studs.

6. A system comprising:

a controller comprising a memory, a control application on the memory, and a processor coupled to the memory and operably configured to execute instructions of the control application;

a plurality of sensors selectively arranged on a turbomachine engine and operably configured to detect and transmit parameters of the turbomachine engine to the controller;

wherein the plurality of sensors detects the parameters and at least one of the plurality of sensors transmits the parameters to the controller, and wherein the controller identifies an upper casing temperature and a lower casing temperature from the transmitted parameters, and under the control of the control application, determines whether a component of the turbomachine engine is above a minimum clearance value for the turbomachine engine based in part on the identified upper and lower casing temperatures.

7. The system of claim 6, wherein the component is above the minimum clearance value, and the controller, under the control of the control application, initiates a restart of the turbomachine engine.

8. The system of claim 7, wherein the controller initiates a restart by generating a message indicative of the component being above the minimum clearance value, and wherein the message is provided to a user of the system visually, in audible, or both.

9. The system of claim 7, wherein the controller initiates a restart by generating a start signal for the turbomachine engine, and transmitting the start signal to the turbomachine engine for restarting the same.

10. The system of claim 6, wherein the component is not above the minimum clearance value, and the controller, under the control of the control application, is configured to delay a restart restriction of the turbomachine engine until it is determined that the component is above the minimum clearance value.

11. The system of claim 6, wherein the plurality of sensors includes a first sensor arranged at an upper part of a casing of the turbomachine, and a second sensor arranged at a corresponding lower part of the casing.

12. The system of claim 11, wherein the first and second sensors are arranged relative to the turbomachine third row vane.

13. A method for starting a turbomachine engine following a shutdown of the turbomachine engine, comprising:

initiating a direct air injection system (DAIS) for injecting air into the turbomachine engine;

monitoring parameters of the turbomachine engine, via a plurality of sensors selectively attached to the turbomachine engine;

identifying an upper casing temperature and a lower casing temperature from the monitored parameters; and determining whether a component of the turbomachine engine is above a minimum clearance value for the turbomachine engine based in part on the identified upper and lower casing temperatures and a cold build clearance value for the turbomachine engine.

14. The method of claim 13 further comprising:

initiating a restart of the turbomachine engine upon determining that the component is above the minimum clearance value.

15. The method of claim 14, wherein initiating a restart of the turbomachine engine comprises:

generating a message indicative of the component being above the minimum clearance and transmitting the message to an operator.

16. The method of claim 14, wherein initiating a restart of the turbomachine engine comprises:

generating a restart signal and transmitting the signal to the turbomachine engine to restart the turbomachine engine while operating on turning gear.

17. The method of claim 13, wherein the plurality of sensors includes a first sensor arranged at an upper part of a casing of the turbomachine, and a second sensor arranged at a corresponding lower part of the casing.

18. The method of claim 17, wherein the first and second sensors are arranged relative to the turbomachine third row vane.

19. The method of claim 13, wherein the component is not above the minimum clearance value, and wherein the method comprises:

delaying a time-based restart restriction of the DAIS operation until it is determined that the component above the minimum clearance value.

20. The method of claim 19 further comprises:

initiating a temperature based lockout restriction upon delaying the time-based restriction, and wherein the temperature based lockout restriction remains active until it is determined that the component is above the minimum clearance value.

* * * * *